United States Patent [19]

Dalrymple et al.

[11] Patent Number: 4,862,155

[45] Date of Patent: Aug. 29, 1989

[54] GRAPHIC DISPLAY SYSTEM WITH SECONDARY PIXEL IMAGE STORAGE

[75] Inventors: John C. Dalrymple; Byron G. Paul, both of Portland, Oreg.

[73] Assignee: Tektronix, Inc., Beaverton, Oreg.

[21] Appl. No.: 113,028

[22] Filed: Oct. 26, 1987

[51] Int. Cl.[4] ..... G09G 1/16

[52] U.S. Cl. ..... 340/747; 340/721; 340/724; 340/799

[58] Field of Search ..... 340/721, 723, 798, 799, 340/724, 747

[56] References Cited

U.S. PATENT DOCUMENTS

| | | | |
|---|---|---|---|
| 4,555,775 | 11/1985 | Pike | 340/721 |
| 4,679,038 | 7/1987 | Bantz et al. | 340/799 |
| 4,700,181 | 10/1987 | Maine et al. | 340/724 |
| 4,760,390 | 7/1988 | Maine et al. | 340/721 |
| 4,761,642 | 8/1988 | Huntzinger | 340/721 |

*Primary Examiner*—Gerald L. Brigance

*Attorney, Agent, or Firm*—Daniel J. Bedell; Robert S. Hulse

[57] ABSTRACT

An improved graphics display system includes a picture processor for processing display lists defining graphic designs, the display lists comprising pixel data and/or instructions for generating pixel data. The system further includes a display controller which stores pixel data in a frame buffer memory and controls a display of graphic designs in accordance therewith. When a display list defining a graphic design is changed but the design is not to be displayed, the display list is processed by the picture processor, but the output pixel data generated by the picture processor is routed not to the display controller but to a control processor which stores the generated pixel data in a second memory. When the design is thereafter to be displayed, the control processor generates a secondary display list including the pixel data stored in the second memory to the picture processor. The picture processor then forwards the pixel data included in the secondary display list to the display controller for storage in the frame buffer memory so as to initiate display of the graphic design.

5 Claims, 6 Drawing Sheets

GRAPHIC DISPLAY SYSTEM WITH SECONDARY PIXEL IMAGE STORAGE

BACKGROUND OF THE INVENTION

The present invention relates to a graphics display system including a picture processor producing pixel data for storage as a pixel image in a frame buffer memory controlling a graphics display, wherein the pixel data output of the picture processor may also be selectively stored as a secondary pixel image in another memory.

A typical computer-aided graphics display system stores graphic designs in the form of display lists in a memory. A display list may include a variety of instructions and data describing various graphic objects comprising a graphic design. In some graphics display systems, display lists are developed and maintained by a control processor, and when a particular graphic design is to be displayed on a computer screen, the display list that describes it is transmitted to a separate "picture processor" which processes the display list to produce control and pixel data transmitted to a display controller. The display controller includes a frame buffer memory for storing incoming pixel data at addresses determined by the control data provided by the picture processor. Graphic designs on the computer screen are formed by an array of pixels of various attributes (e.g. color, intensity, etc.), and the pixel data at each address indicates display attributes of a separate pixel. The display controller periodically refreshes the display in accordance with the pixel data currently in the frame buffer memory.

Display lists produced by some graphic design software include concise instructions for producing relatively large amounts of pixel data. For example, a line extending between two points in a particular coordinate system may be represented in a display list as a short sequence of data defining the coordinates of the two points and identifying various attributes of line including color, thickness, etc. The data sequence describing the line is preceded by an instruction to the picture processor indicating the format of the data sequence to follow. In response to the instruction, the picture processor processes the data sequence to produce pixel data corresponding to each pixel to be included in the line on the screen. Prior to sending the pixel data to the display controller, the picture processor also generates and transmits control data to the display controller telling it how to compute the frame buffer memory addresses at which to store the pixel data. Thereafter, as the picture processor transmits pixel data to the display controller, the display controller generates appropriate frame buffer memory addresses and stores the pixel data in the frame buffer memory.

However, a line or other graphic object may also be represented in a display list as a sequence of pixel data directly mapping the object onto the screen, the sequence being preceded by control data indicating the sequence is pixel data and indicating the addresses in the frame buffer memory at which the pixel data is to be stored. In response to such control data, the picture processor passes the pixel and control data on to the display controller without extensive processing inasmuch as the pixel and control data in the display list is already substantially in the form required by the display controller. Thus, the picture processor typically uses less time to process a display list that includes primarily pixel and control data than it uses to process a display list containing high level instructions for computing control and pixel data. However, when possible, graphic design software typically produces display lists using high level instructions rather than bit-mapped pixel data to describe graphic objects because such formats are usually more compactly stored and easier for a general purpose control processor to manipulate.

In some systems, separate display lists may be maintained for each of multiple graphic designs, and selected portions ("windows") of one or more of the designs may be displayed at the same time on the CRT screen. When a display defining a graphic design is sent to the picture processor, a set of instructions is added to the display list to indicate the window to be displayed and the location of a particular area ("viewport") of the CRT wherein the window is to be displayed. Windows may usually be moved about on the screen in response to operator commands, and one window may partially or completely overlap another. When, for example, a first window moves across a second window, temporarily covering and then uncovering the second window, the picture processor must process display lists describing both windows many times so that both windows are redrawn in rapid succession in order to provide smoothly animated movement of the first window over the second. However, when the display lists are in forms requiring extensive processing, the picture processor may not be able to supply pixel data to the display controller fast enough to provide an illusion of smooth window movement.

SUMMARY OF THE INVENTION

A graphics display system includes a main memory, a control processor, and a picture processor interconnected by a computer bus. The main memory stores primary display lists comprising sets of instructions defining graphic designs, the primary display lists being produced by the control processor. The picture processor reads and processes the primary display lists to provide control data and pixel data for transmission to a display controller. The display controller stores the pixel data in the form of a pixel data array ("pixel image") in a frame buffer memory and produces a graphics display on a cathode ray tube (CRT) screen, the display being defined by the stored pixel image. In accordance with one aspect of the invention, a routing circuit is provided in the data path between the picture processor and the display controller to permit output data supplied by the picture processor to be selectively routed away from the display controller and onto the computer bus in response to commands from the control processor.

In accordance with another aspect of the invention, the control processor reads the control and pixel data placed on the computer bus and generates a secondary pixel image in main memory, the secondary pixel image being similar to a pixel image that would otherwise be provided by the display controller had the control and pixel data output of the picture processor been sent to the display controller.

In accordance with a further aspect of the invention, when the display is to be updated, the control processor may incorporate the pixel data stored in the main memory into a secondary display list and forward to the picture processor the secondary display list, rather than the primary display list from which the pixel data was derived. The secondary display list represents the same graphic design defined by the primary display list but comprises pixel and control data that is already substantially in a form that can be understood by the display controller. Thus, the picture processor can process the secondary display list more rapidly than the primary display list. This aspect of the invention is useful, for example, in a system wherein several graphic designs are displayed in separate overlapping windows on a screen. A secondary pixel image of a window that is partly or entirely covered may be maintained in main memory, and updated whenever the primary display list upon which it is based is changed. As a portion of the window is uncovered, the graphics display is updated by generating and transmitting a secondary display list conveying the pixel data stored in main memory to the picture processor, rather than the corresponding primary display list which may no longer be in memory. Since the secondary display list includes data that is already substantially in a form that can be understood by the display controller, the picture processor may quickly forward the data to the display controller with minimal processing so the display can be updated quickly.

It is accordingly an object of the invention to provide an improved graphics display system wherein pixel and control data generated by a picture processor in response to a display list may be selectively directed either to a display controller for producing a display therefrom or to a processor for creating therefrom a secondary pixel data image in a memory.

The subject matter of the present invention is particularly pointed out and distinctly claimed in the concluding portion of this specification. However, both the organization and method of operation of the invention, together with further advantages and objects thereof, may best be understood by reference to the following description taken in connection with accompanying drawings wherein like reference characters refer to like elements.

DESCRIPTION OF THE PREFERRED EMBODIMENT

Figure 1:
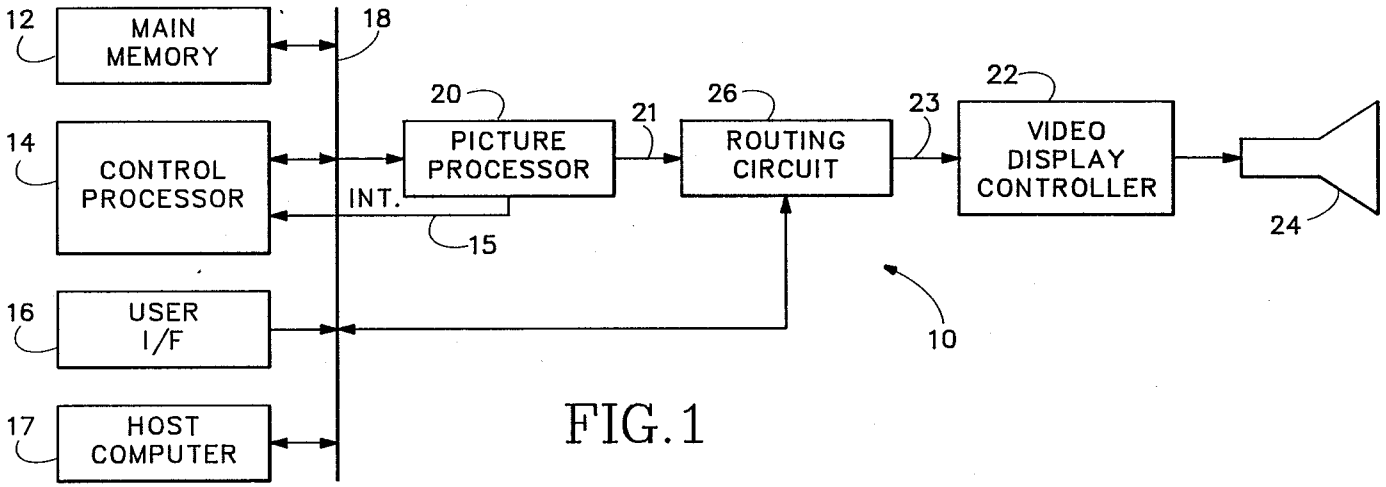
FIG. 1 is a block diagram of an improved graphics display system in accordance with the present invention.

With reference to FIG. 1, a graphics display system 10 includes a main memory 12 for storing primary display lists, each primary display list comprising instructions for producing a graphics display on a screen. A primary display list may be produced and transmitted to main memory 12 by a host computer 17, and may be altered by a control processor 14 under control of graphic design software that may also be stored in memory 12. Control processor 14 may alter a primary display list in memory 12 in order to change the graphic design that it represents in response to user commands supplied to control processor 14 through a keyboard, a mouse, a remote computer and/or other input devices via user interface circuitry 16. Main memory 12, processor 14, user interface circuit 16, and host computer 17 are interconnected through a computer bus 18 which is also connected to a picture processor 20.

A primary display list stored in main memory 12 may be read out and supplied to picture processor 20 via bus 18. Picture processor 20 is a dedicated processor adapted to process display lists at high speed so as to generate pixel and control data transmitted via a first local display bus 21, a routing circuit 26, and a second local display bus 23 to a video display controller 22. The display controller 22 stores the pixel data that it receives in a frame buffer memory included therein, and uses the stored pixel data to control video signals that refresh a display produced on the screen of cathode ray tube (CRT) 24. Thus, the graphics display system 10 operates as a data processing pipeline to update a displayed graphic design. The first stage of the pipeline is the control processor 14 or host computer 17 which stage provides a primary display list for storage in main memory 12, and the second stage of the pipeline is the picture processor 20 which processes the primary display list to produce control and pixel data. The third stage of the pipeline is the video display controller 22 which stores the pixel data in its internal frame buffer memory and controls a display accordingly. The picture processor 20 itself may also have an internal architecture whereby primary display lists are processed in pipeline fashion.

While the control processor 14 is suitably a general purpose microprocessor, the picture processor 20 is a dedicated instruction processor adapted to rapidly process display lists so as to generate control and pixel data for the display controller 22. In some graphics display systems of the prior art, a general purpose processor that manipulates the primary display lists also carries out the function of the picture processor 20, but use of a dedicated, special purpose picture processor 20 to provide the pixel data from display lists improves the speed of display updates because a dedicated picture processor can process display lists more quickly than a general purpose microprocessor. In addition, the pipeline architecture of the system permits the picture processor 20 to process display lists at the same time the control processor is carrying out other operations.

Display lists often convey "high level" instructions which require the picture processor 20 to carry out various processing operations in order to translate them into control and pixel data suitable for transmission to the display controller 22. Display lists may also directly convey pixel and control data that is already in a form that may be transmitted to the display controller without substantial processing. The picture processor 20 therefore requires less time to process a primary display list that includes mostly low level pixel and control data than it requires to process a display list containing mostly high level instructions for producing pixel data. However, graphic design software often utilize display lists that contain high level instructions because they are usually more compactly stored in main memory 12 and can be more rapidly manipulated by the control processor 14 or host computer 17 to effect a change in graphic designs represented by the display lists.

In accordance with the invention, output routing circuit 26 is inserted in the data path between the picture processor 20 and the display controller 22, and is also connected to computer bus 18. Control processor 14 may command the routing circuit to transmit the pixel and control data output of the picture processor 20 back to the control processor 14 via bus 18 rather than to the video display controller 22. The control processor 14 reads the control and pixel data placed on computer bus 18 and provides in main memory 12 a pixel data array ("pixel image") similar to a pixel image that would otherwise be produced in the frame buffer memory within the display controller 22 had the control and pixel data been sent to the display controller. Thereafter, the control processor 14 may incorporate the pixel data stored in main memory 12 into a "secondary" display list, also defining the graphic design, but directly including control and pixel data rather than high level instructions for producing such data. When this secondary display list, rather than the primary display list from which it was derived, is sent to the picture processor 20, the picture processor can rapidly process the secondary display list and pass the control and pixel data included therein to the display controller 22 for quickly updating the pixel image stored therein.

The creation and maintenance of the secondary pixel image in the main memory 12 is useful, for example, when several graphic designs are displayed in separate, sometimes overlapping windows on a screen. A secondary pixel image of a window partly or entirely covered by another window may be maintained in main memory 12 and updated whenever the primary display list upon which it is based is changed. As a portion of the window is uncovered, the control processor 14 may initiate update of the graphics display by generating and transmitting a secondary display list conveying the pixel image stored in main memory 12 to the picture processor 20, rather than by transmitting the primary display list to the picture processor. Since the secondary display list includes pixel and control data that is already substantially in a form that the display controller can understand, the picture processor 20 may quickly forward the data to the display controller with minimal processing so that the display may be rapidly updated. In addition, primary display lists may only be temporarily stored in main memory 12 immediately prior to transmission to picture processor 20 and may be written over thereafter by other data. Maintenance of a secondary pixel image and generation of secondary display lists therefrom obviates the need for obtaining a primary display list from host computer 17 whenever a window is uncovered.

A secondary pixel image may also be maintained in main memory 12 for a graphic design defined by a primary display list that is occasionally altered but wherein the design is not always displayed on CRT 24. Each time the primary display list is updated, it is transmitted to the picture processor 20, but routing circuit 26 routes the output of the picture processor back to the control processor 14 instead forwarding it to the display controller 22, and the control processor maintains a secondary pixel image of the display in the main memory. Thereafter, the control processor can quickly initiate display of the design by providing the picture processor with a secondary display list conveying the secondary pixel image rather than by providing it with the primary display list upon which the secondary pixel image is based.

Figure 2:
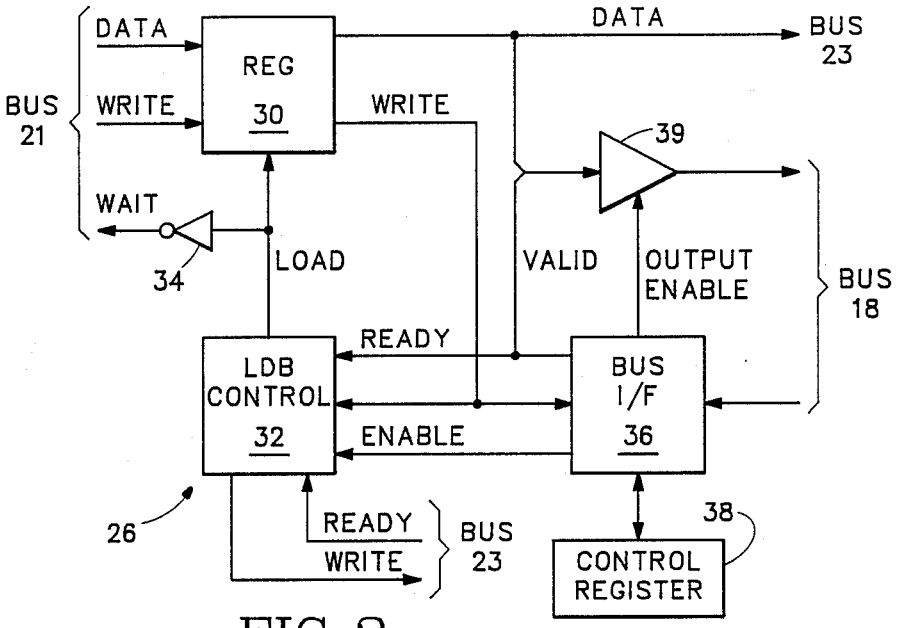
FIG. 2 is a block diagram of the routing circuit of FIG. 1.

FIG. 2 is a block diagram of routing circuit 26 of FIG. 1. Local display bus 21 conveys a set of DATA bits and a WRITE signal to a register 30 within routing circuit 26 and conveys a WAIT signal from the routing circuit back to the picture processor. Register 30 is input enabled by a LOAD signal from a local display bus (LDB) control circuit 32 which receives a READY signal from the display controller via bus 23 when it is ready to receive data on bus 23. LDB control circuit 32 continuously asserts the LOAD signal after the READY signal is asserted, thereby causing any data on bus 21 to be loaded into register 30. The WRITE bit of the data in register 30 is supplied as input to LDB control circuit 32. When the WRITE bit is set, indicating valid data is on the local display bus 21, LDB control circuit 32 deasserts the LOAD signal so that register 30 is no longer input enabled. LDB control circuit then transmits a WRITE signal to the display controller via bus 23 to indicate that valid data is on bus 23. The display controller thereupon deasserts the READY signal, reads and processes the data on bus 23, and later reasserts the READY signal when it is ready to accept more data. The LOAD signal generated by LDB control circuit 32 is also applied as input to a buffer 34 which provides as output the WAIT signal transmitted to the picture processor. When the LOAD signal is deasserted, the WAIT signal tells the picture processor not to place new data on bus 21. When the LOAD signal is subsequently asserted, the WAIT signal tells the picture processor that it may place more data on bus 21. If the picture processor has no data to send on bus 21, it resets the WRITE bit to indicate that valid data is not on the bus.

The control processor 14 of FIG. 1 determines whether the routing circuit 26 forwards data to the display controller or back to the control processor via the computer bus 18. Routing circuit 26 further includes bus interface circuit 36 for decoding I/O space addresses placed on computer bus 18, for storing data placed on computer bus 18 in a control register 38 when it is addressed, and for decoding instructions on the computer bus. An ENABLE bit stored in control register 38 is supplied to LDB control circuit 32 and when the ENABLE bit is set, the routing circuit routes data to the computer bus 18. The bus interface circuit 36 also output enables a buffer 39 in response to control signals conveyed on bus 18, and when output enabled, buffer 39 forwards the DATA bits in register 30 and a VALID bit produced by bus I/F circuit 36 onto computer bus 18. The WRITE bit in register 30 is supplied as input to bus interface circuit 36 which sets the VALID bit to indicate the state of the WRITE bit.

When the ENABLE bit is set, LDB control circuit 32 ignores the READY signal from the display controller and refrains from asserting the WRITE signal to the display controller so that the display controller does not read data on bus 23. Instead, data stored in register 30 and the VALID bit are placed on the computer bus 18 when buffer 39 is output enabled, and the interface circuit 36 transmits a READY signal to LDB control circuit 32 when the control processor indicates via signals on bus 18 that it has read the data on the computer bus. The LDB control circuit 32 controls the LOAD signal in response to the READY signal produced by bus interface circuit 36 in the same way that it otherwise would control the LOAD signal in response to the READY signal from the display controller.

Thus, when the ENABLE bit is not set, routing circuit 26 forwards data on bus 21 to the display controller via bus 23 and asserts the WRITE signal so as to cause the display controller to accept the data on bus 23. On the other hand, when the ENABLE bit is set, routing circuit 26 forwards the data on bus 21 to the control processor 14 of FIG. 1 via the computer bus 18. The mode of operation of routing circuit 26 is controlled by control processor 14 via control data supplied on bus 18 and stored in control register 38.

Figure 3:
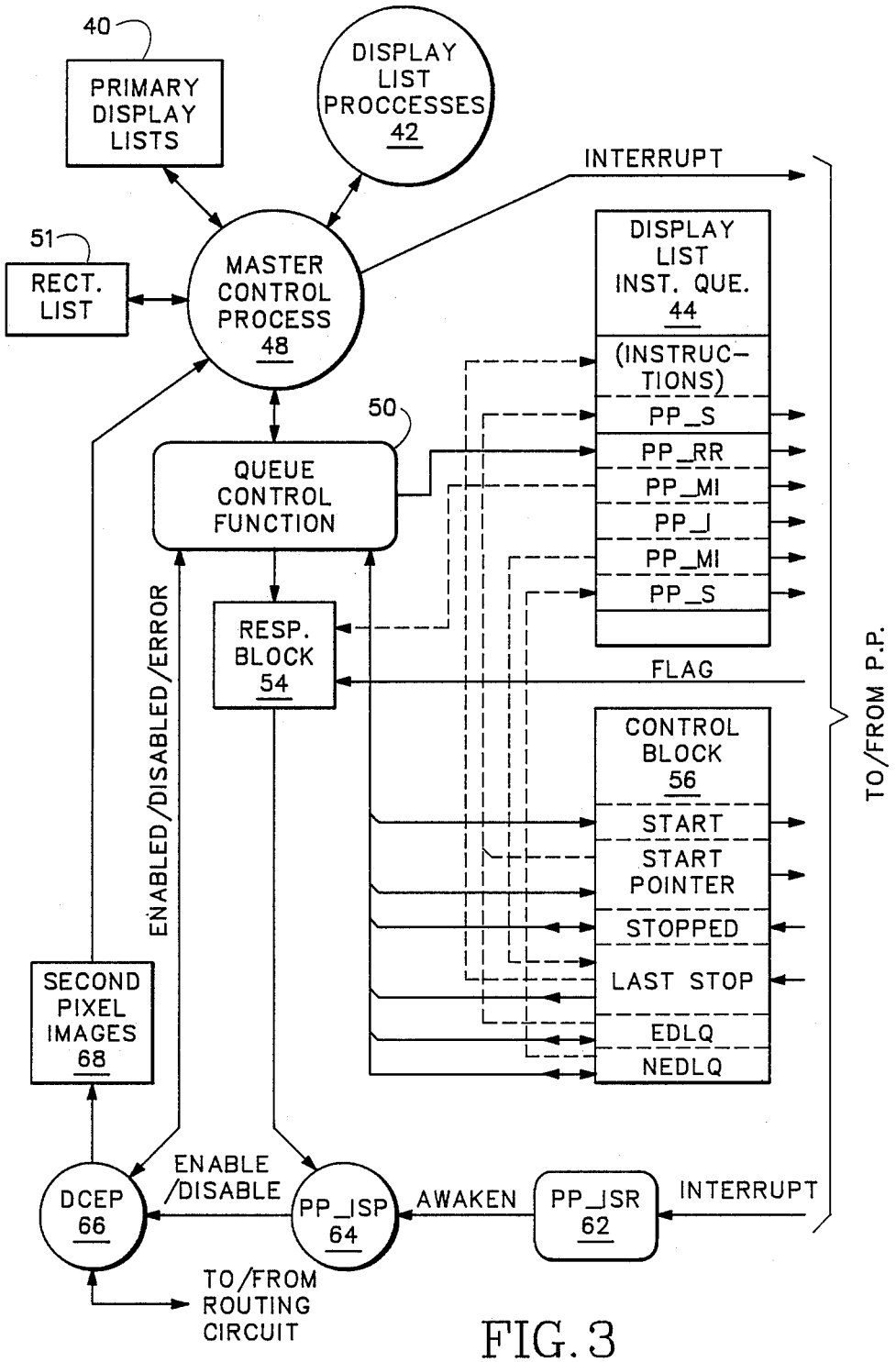
FIG. 3 is a data flow diagram illustrating message and data transfer between processes and functions executed by the control processor of FIG. 1.

FIG. 3 is a data flow diagram illustrating how various software processes and functions implemented by the control processor 14 of FIG. 1 interact with picture processor 20 and routing circuit 26. In FIG. 3, processes are represented by ellipses, functions are represented by boxes with rounded edges, and blocks of data stored in main memory 12 of FIG. 1 are represented by boxes with squared edges. The direction of data or message flow is represented by solid arrows while the direction of a pointer in one memory address to another memory address in main memory 12 is represented by a dotted arrow.

Control processor 14 of FIG. 1 is suitably of the type which may concurrently implement multiple processes that communicate with one another by messages. Each primary display list 40 is stored in the main memory by a master control process 48, the primary display lists being provided by display list processes 42 which may execute graphic design software to create primary display lists or which acquire primary display lists from host computer 17 of FIG. 1. A display list process 42 may request a master control process 48 to transmit a primary display list to the picture processor. The master control process 48 calls a display list instruction queue control function 50 which maintains a display list instruction queue 44 containing instructions to be executed by the picture processor. The picture processor accesses and executes instructions in queue 44 in the order that they are stored. The instruction queue 44 comprises a set of contiguous addresses in main memory reserved for storing the instructions. When a new set of instructions are to be added to the queue, but there is not sufficient space near the end of the address space reserved for the queue to hold the new instructions, the queue control function adds a "jump" instruction as the last instruction in the queue to redirect the picture processor back to the start of the the queue, the function waits until a sufficient number of instructions at the front of the queue have been executed by the picture processor, and then overwrites previously executed instructions at the beginning of the queue with the new instruction set.

To "transmit" a primary display list to the picture processor, the master control process 48 calls the queue control function 50 and supplies it with information regarding the address and length of the display list. The queue control function 50 adds a set of instructions to the queue 44 which point to the starting address in main memory of the primary display list, indicate the length of the display list, and tell the picture processor to read the display list starting at that address. Upon reaching the instruction set, the picture processor sequentially reads and processes instructions and data in the display list, and then resumes reading and executing instructions in the display list instruction queue 44. The next instruction placed by the queue control function 50 in the instruction queue following a set of instructions for reading a display list is a "move immediate" instruction (PP_MI) that tells the picture processor to store a LAST STOP pointer in a control block 56, a portion of the main memory address space reserved for storing control data, flags and picture processor commands. The LAST STOP pointer points to the address of the next instruction following the PP_MI instruction. This next instruction is a "stop" instruction (PP_S) that tells the picture processor to stop reading instructions from the instruction queue 44 and also to set a STOPPED flag in control block 56.

The queue control function 50 stores an "end of display list instruction queue" (EDLQ) pointer in control block 56 pointing to the address of the last instruction (i.e. the PP_S instruction) that is stored in the queue. Prior to adding a new set of instructions to the instruction queue, the queue control function 50 checks the EDLQ and the LAST STOPPED pointers to determine a starting address at which to add the new instructions and to determine whether there is room at the beginning or end of the queue to add the instructions. Since the picture processor resets the LAST STOPPED pointer every time it completes processing a display list, the LAST STOPPED pointer is an indication of how far into the display list instruction queue the picture processor has progressed. When the pointers indicate there is room in the queue to add the instructions, queue control function 50 adds them, along with the previously mentioned PP_MI and PP_S instructions to the queue. The function 50 also sets a "new end of display list instruction queue" (NEDLQ) pointer to indicate the memory address of the last instruction (the PP_S) just added to the queue. The NEDLQ pointer is also included in control block 56.

However, the queue control function 50 does not yet update the EDLQ pointer. Instead, function 50 checks the EDLQ pointer to determine the address of the PP_S instruction formerly at the end of the queue, and overwrites that instruction with a "no-operation" (NO_OP) instruction. This instruction tells the picture processor to continue reading instructions from the queue without stopping. Control function 50 then checks the STOPPED flag to determine if the picture processor is in fact stopped. If so, the queue control function resets the STOPPED flag and sets the START pointer in control block 56 equal to EDLQ, the address of the NO_OP instruction that precedes the most recently added set of instructions. The queue control function 50 then places a START command in control block 56 and transmits an interrupt to the picture processor via the computer bus. In response to the interrupt, the picture processor reads the START command in the control block. This command tells the picture processor to resume reading instructions in the display list starting at the address indicated by the START pointer in control block 56. Thereafter, queue control function 50 sets EDLQ pointer equal to the NEDLQ pointer to indicate the address of the last instruction placed in the queue and then ends.

The master control process 48 maintains a rectangle list 51 containing information regarding the display of various graphic designs including information indicating what portions of various graphic designs represented by each primary display list 40 are to be displayed in windows on the CRT screen, the position of each window on the screen, and the order in which windows overlap. When a display list process 42 indicates by a message that it wants to send a primary display list 40 to the instruction queue, the master control process 48 amends the display list to include instructions obtained from a rectangle list 51, for example telling the picture processor that pixel data representing portions of the design outside designated windows or representing portions of a window that are covered by another window is not to be forwarded to the display controller. The master control process 48 may then call the display list instruction queue control function 50 to forward the primary display list to the picture processor via instructions placed in the instruction queue. When the picture processor subsequently processes the display list, it refrains from sending pixel data to the display controller defining portions of a graphic design not included in a window or which are covered by another window.

The master control process 48 also selects the mode of operation of routing circuit 26 of FIG. 1 by which the output of the picture processor 20 is routed either to the computer bus 18 or to the display controller 22. To change the mode of operation of the routing circuit, the master control process 48 invokes queue control function 50 and passes thereto arguments indicating whether the routing circuit is to route data to the display controller or to the computer bus, and also indicating the main memory address and dimensions of a particular secondary pixel image to be updated if the output of the picture processor is to be routed to the computer bus.

When called to change the routing of the data output of the picture processor, queue control function 50 sets up in main memory a "response" block 54 containing instructions to be carried out by the control processor 14 of FIG. 1 (such as switching the operating mode of the routing circuit) when the picture processor 20 subsequently transmits an interrupt to the control processor via an interrupt line 15 shown in FIG. 1. The queue control function 50 then adds a particular set of instructions to the display list instruction queue 44 in the same manner that it adds instructions for reading display lists as described hereinabove. When the picture processor 20 has a pipelined internal architecture it may at any given time be engaged in processing more than one display list instruction. In order to ensure that all instructions in the picture processor pipeline are executed prior to switching the routing mode of routing circuit 26, the first instruction that queue control function 50 of FIG. 3 places in instruction queue 44 is a "PP-RR" instruction which causes the picture processor to complete processing all of the instructions currently in its pipeline before obtaining another instruction from the queue.

The next instruction in the queue is a move immediate instruction (PP_MI) telling the picture processor to set an INTERRUPTED flag in response block 54. (The purpose of this flag will be discussed hereinbelow.) Thereafter, an interrupt (PP_I) instruction in the queue tells the picture processor to interrupt the control processor via interrupt line 15 of FIG. 1. Following the interrupt instruction, another PP_MI instruction causes the picture processor to store the next queue address as the LAST STOP pointer in block 56. The last instruction supplied to instruction queue 44 by the queue control function is a stop instruction PP_S which tells the picture processor to stop accessing the display list instruction queue and to set the STOPPED flag in the control block 56.

The interrupt signal transmitted by the picture processor to the control processor in response to the interrupt instruction PP_I in instruction queue 44 tells an interrupt service routine (PP_ISR) 62 to awaken an interrupt service process (PP_ISP) 64. The interrupt service process 64 checks all response blocks that may be stored in the main memory to find one that includes an INTERRUPT flag that has been set. In this case, the picture processor generated the interrupt after setting the INTERRUPT flag in the particular response block 54 set up by queue control function 50. On detecting the interrupt flag in response block 54, the interrupt service process 64 reads and executes instructions contained in the response block, and these instructions tell it to transmit a message to a display controller emulation process 66.

Emulation process 66 maintains one or more secondary pixel images 68 in the main memory and also controls the mode of operation of the routing circuit 26 of FIGS. 1 and 2. The message sent to the emulation process 66 indicates whether the data output of the picture processor is to be routed onto the computer bus. If the message indicates such routing is to be enabled, it also indicates which secondary pixel image 68 is to be updated in accordance with control and pixel data routed to the computer bus. In response to an incoming ENABLE message, the emulation process 66 transmits an instruction to the routing circuit 26 of FIG. 2 via the computer bus 18 causing the routing circuit to set the ENABLE bit in its control register 38, and thereby causing the routing circuit to forward data to the computer bus 18 rather than to the display controller. The emulation process 66 then transmits an ENABLED message to the queue control function 50 and begins reading control and pixel data placed on the computer bus by the routing circuit and updating a particular secondary pixel image 68 identified by the ENABLE message in accordance with the data that it reads.

When the queue control function 50 receives an ENABLED message it returns an indication of the message received to the master control process 48 so that the master control process may resume transmitting display lists to the picture processor via the display list queue. Thereafter, until such time as the mode of operation of the routing circuit is changed, the pixel and control data that the picture processor produces in response to these display lists will be transmitted to the display controller emulation process 66 rather than to the display controller, whereby the emulation process can update a secondary pixel image 68 in the main memory.

On the other hand, when response block 54 tells interrupt service process 64 to send a DISABLE message to the emulation process 66, the emulation process resets the ENABLE bit in register 38 of FIG. 2 so that the routing circuit subsequently begins routing data to the display controller rather than to the computer bus 18. The emulation process also transmits a DISABLED message to queue control function 50 causing the queue control function to return an indication to the master control process that routing of pixel and control data to the computer bus has been disabled. Thereafter, the master control process resumes transmitting display lists to the picture processor, and until the mode of operation of the routing circuit is again changed, the pixel and control data that the picture processor produces will be forwarded to the display controller. The display controller emulation process 66 sends an ERROR message to the queue control function 50 when the interrupt service process sends a DISABLE message to process 66 when routing of pixel data to the computer bus is already disabled. The queue control function 50 returns an indication of the error to the master control process 48 upon termination.

When a secondary pixel image 68 corresponding to a primary display list 40 is maintained and is up to data insofar as it reflects the current state of a corresponding primary display list, the master control process 48 may form and store in main memory a secondary display list referencing pixel data stored in the secondary pixel image. The master control process then calls the queue control function 50 to send the secondary display list to picture processor, utilizing the display list instruction queue 44 in the same manner that it uses the queue to send a primary display list to the picture processor. The master control process does this when changes to the rectangle list 51 indicate that a change in the primary pixel image in the frame buffer memory is needed, for example, in order to move or change the size of a displayed window or to alter a portion of the window that is covered. Since the picture processor is able to process such a secondary display list more rapidly than it is able to process the primary display list, the frame buffer memory in the display controller can be updated more quickly.

Figure 4:
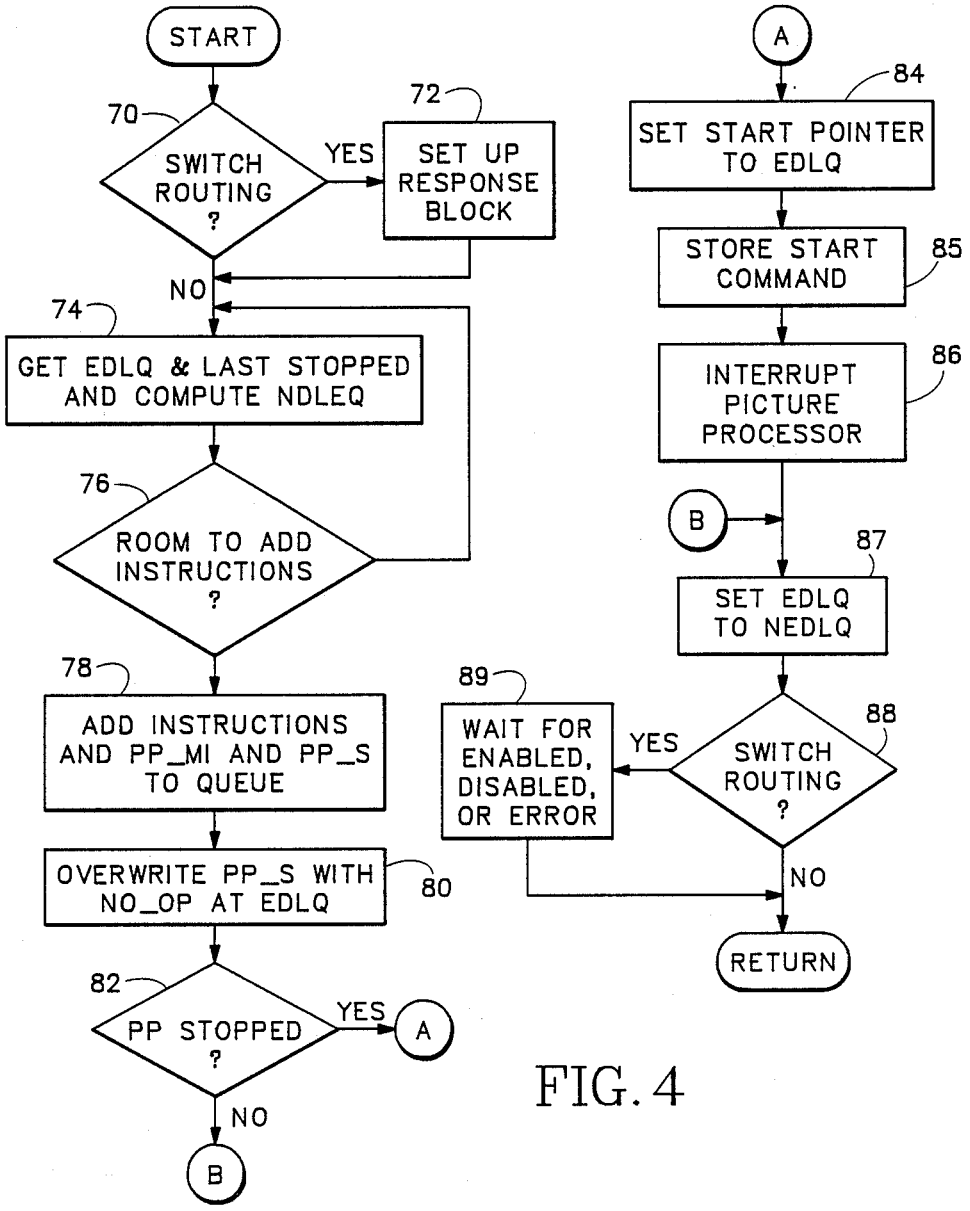
FIG. 4 is a flow chart illustrating operation of the queue control function of FIG. 3.

FIG. 4 is a flow chart for software implementing the queue control function 50 of FIG. 3. Starting at step 70, if the call to the queue control function from the master control process includes an argument indicating that the queue control function is to enable or disable pixel data routing to the computer bus, the queue control function sets up the response block 54 of FIG. 3 (step 72). After step 70 (or after step 72 if executed), the queue control function reads the EDLQ and LAST STOPPED pointers in control block 56 of FIG. 3 and, based on the number of instructions to be added to the queue and the value of EDLQ, the function computes (step 74) where the address NDLEQ of the last instruction in the instruction queue would fall. From the values of NEDLQ and LAST STOPPED, the queue control function determines whether there is sufficient room in the queue to store the instructions to be added (step 76). If not, the function continues to check the value of LAST STOPPED until it indicates that the picture processor has executed enough instructions in the queue to free up sufficient space for holding the new instructions. At this point the queue control function adds the new instructions to the queue, including a jump instruction if necessary to redirect the picture processor to the front of the queue address space, and also including the move immediate PP_MI and stop PP_S instructions (step 78). It then overwrites the preceding stop instruction PP_S at the address indicated by the EDLQ pointer with a NO_OP instruction (step 80) and checks the STOPPED flag in control block 56 of FIG. 3 to determine if the picture processor is indeed stopped (step 82). If so, the function sets the START pointer to the value of EDLQ to indicate the address of the first instruction of the new instruction set (step 84), stores a START command in the control block (step 85), and interrupts the picture processor (step 86).

After step 86, or immediately after step 82 if the picture processor is not stopped, the queue control function sets the value of EDLQ to equal NEDLQ (step 87). If the function was called to switch pixel data routing (step 88), then it waits (step 89) for an ENABLED, DISABLED or ERROR message from the display controller emulation process 66 of FIG. 3 indicating when and how pixel routing has been switched or indicating that an error has occurred. Thereafter, the function returns an indication of the message received to the master controller. If the function was not called to switch pixel data routing (step 88), the function simply returns, indicating that it has completed its operation.

Figure 5:
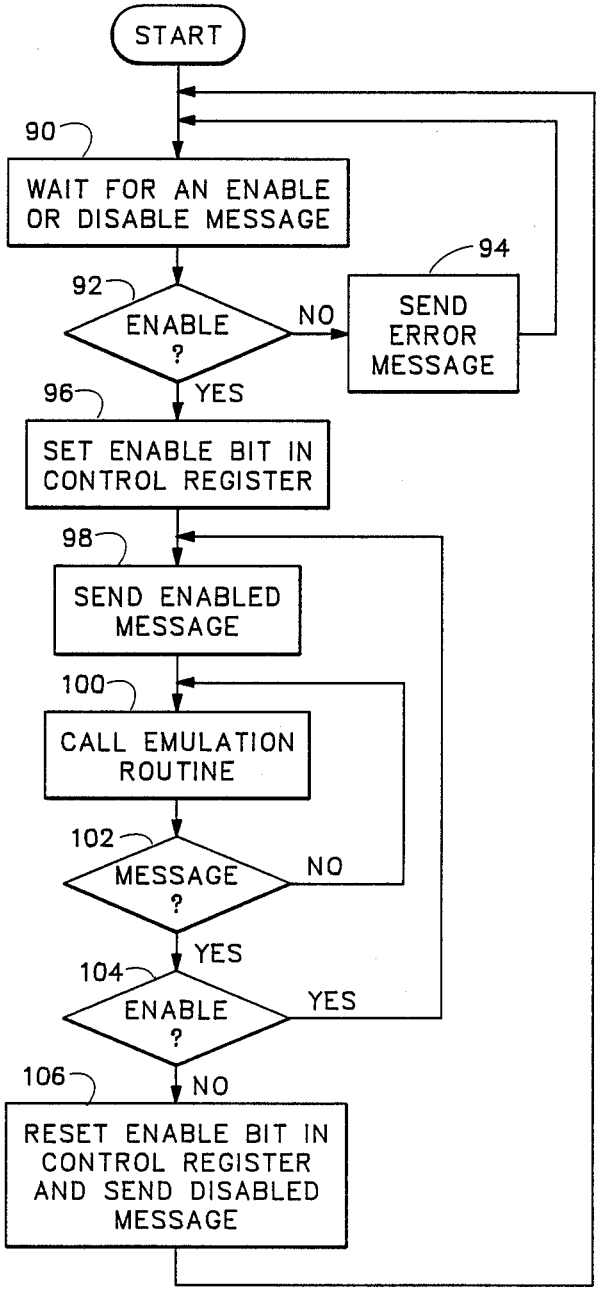
FIG. 5 is a flow chart illustrating operation of the display controller emulation process of FIG. 3.

FIG. 5 is a flow chart illustrating operation of the display controller emulation process 66 of FIG. 3. On system startup the process waits for an ENABLE or DISABLE message from the interrupt service process (step 90). Routing of pixel data from the picture processor to the computer bus should initially be disabled, so if the message is not ENABLE (step 92), the process sends an ERROR message to the queue control function (step 94) and returns to step 90. If the message received is ENABLE, the ENABLE bit is set in the control register 38 of FIG. 2 (step 96), and an ENABLED message is sent to the queue control function (step 98). A display controller emulation routine is then called (step 100) and supplied with an argument that references a starting address and dimensions of a particular secondary pixel image maintained in the main memory, the pixel image address being identified by the message received in step 90. The emulation routine reads and processes control and pixel data placed on the computer bus by the routing circuit and updates the identified secondary pixel image accordingly. Thereafter (step 102), the process checks to see if another ENABLE or DISABLE message has been sent by the interrupt process. If not, the emulation routine is again called (step 100) to acquire and process additional data on the computer bus. However, if an ENABLE message is received (step 104), the process returns to step 98 where it sends another ENABLE message to the queue control function. If a DISABLE message is received in step 102, the emulation process flows from step 102 through step 104 to step 106 wherein the process resets the ENABLE bit in the control register of the routing circuit whereby routing of data to the computer bus is disabled. The emulation process also forwards the DISABLED message to the queue control function. Thereafter, the emulation process returns to step 90 to wait for another message.

The nature of the emulation routine called in step 100 of FIG. 5 depends on the nature of the display controller 22 of FIG. 1 that it emulates. In the preferred embodiment of the invention, the picture processor 20 of FIG. 1 sends sequences of pixel data to the display controller, each pixel data sequence being preceded by control data conveying a starting address of the frame buffer memory in the display controller at which the first pixel data element of the sequence is to be stored in the frame buffer memory. The control data also indicates how the initial address is to be incremented or decremented for each successive element of the pixel data sequence and indicates how the pixel data may be modified prior to storage.

Frame buffer memory addressing is organized into a two-dimensional X,Y array wherein each address has an X and a Y component. The display on the screen of CRT 24 of FIG. 1 is formed by a corresponding X,Y array of pixels, and the pixel data stored at address (X,Y) controls display attributes of a pixel at a point (X,Y) on the screen. The X component of the starting address is loaded into an X address counter and the Y component of the starting address is loaded into a Y address counter. Each counter may count up or down from the starting address X and Y components each time the display controller receives an additional element of the pixel data sequence. The outputs of the counters address the frame buffer memory as the pixel data element is stored therein. The direction of the count of each counter is controlled by the addressing control data that precedes the pixel data sequence which control data is loaded into an addressing control register within the display controller. An additional addressing control bit (an INHIBIT bit) accompanying each pixel data element of the sequence may also inhibit one of the counters from counting so that only an X or only a Y component of the address is incremented or decremented, the particular component to be inhibited being determined by the previously stored addressing control data.

Each sequence of pixel data transmitted to the display controller represents a single pixel or a line of several pixels that may extend in any direction on the CRT screen from the pixel at point (X,Y). The direction of the count of each address counter controls the manner in which the frame buffer memory address is changed before each pixel data element of a sequence is stored, and the X and Y portions of the frame buffer memory address are each incremented, decremented or held constant in accordance with the addressing control data and the INHIBIT bit transmitted with the pixel data so that the stored pixel data controls a line of pixels on the screen starting at the designated starting point (X,Y) and extending in the appropriate direction.

The display controller includes circuitry that can perform various logical or masking operations on the pixel data before it is stored in the frame buffer memory. Such operations are useful, for example, when each bit of a pixel data element controls a separate "layer" of the display. By masking various bits of incoming pixel data elements before storing them in the frame buffer memory, display of various layers of the display can be inhibited. The particular operation to be performed by the logic and masking circuitry on each element of a pixel data sequence is controlled by control data stored in control registers within the display controller sent thereto by the picture processor prior to transmission of the pixel data sequence.

Figure 6:
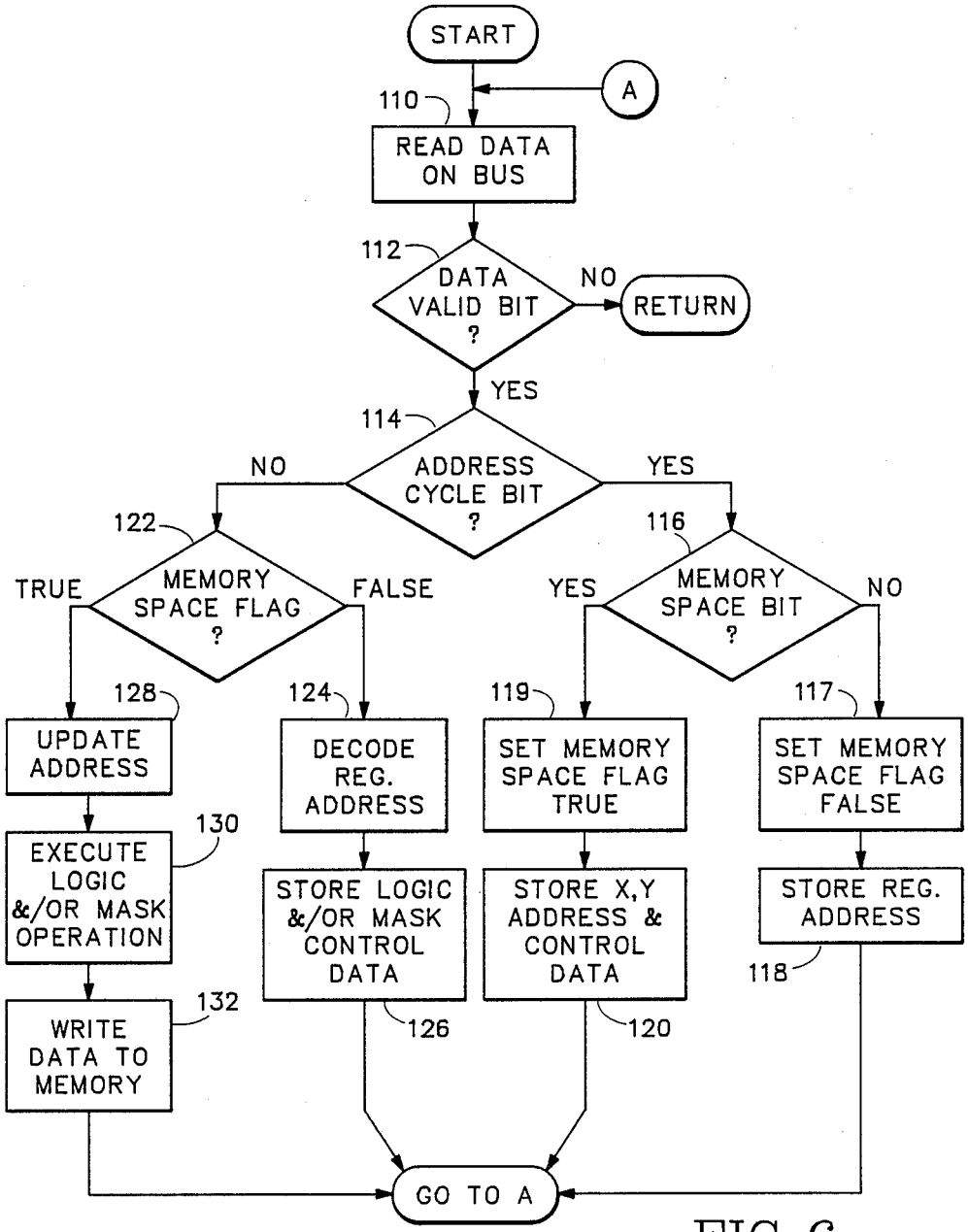
FIG. 6 is a flow chart illustrating operation of the emulation routine of FIG. 5.

FIG. 6 is a flowchart illustrating operation of the routine invoked in step 100 of FIG. 5 that emulates operation of the display controller 22 in regard to creating a pixel image from output data produced by the picture processor. Starting with step 110, the routine reads the data currently on the computer bus and checks (in step 112) the VALID bit supplied by interface circuit 36 of FIG. 2 to determine if the data is valid. If the data is not valid the routine ends. If the data on the bus is valid, an ADDRESS_CYCLE bit indicating whether the data conveys addressing information is checked in step 114. If addressing information is conveyed by the incoming data, then (step 116) a MEMORY_SPACE bit is checked. If not set, the MEMORY_SPACE bit indicates that the incoming data on the computer bus conveys an address of a control register in the display controller for storing data controlling the nature of logical or masking operations to be performed on pixel data to follow. In such case a MEMORY_SPACE flag is set false (step 117) and the register address included in the incoming data is stored (step 118). Alternatively, when the MEMORY_SPACE bit is set, it indicates the incoming data conveys the X,Y starting address for a sequence of pixel data to follow and conveys data that controls the way in which the frame buffer memory address is to be incremented. In this case, the routine sets the MEMORY_SPACE flag true (step 119) and stores the starting X,Y address and control data (step 120).

If the ADDRESS_CYCLE bit is not set (step 114), the incoming data includes either pixel data or data for controlling logic operations on pixel data. In such case, the MEMORY_SPACE flag is checked (step 122) and if this flag is false, the incoming data conveys control data for controlling masking or logical operations on pixel data. Therefore, the control register address last stored in step 118 is decoded (step 124) to determine the particular control data included in the incoming data, and that control data is stored (step 126) for use in controlling subsequent operations on incoming pixel data.

If the MEMORY_SPACE flag is true (step 122), it indicates that the incoming data is pixel data, and therefore a stored X,Y frame buffer memory address is updated appropriately (step 128) in accordance with the addressing control data last stored in step 120, and in accordance with the previously discussed INHIBIT bit included with the incoming pixel data. The pixel data is optionally masked or otherwise altered (step 130) in a manner indicted by the logic and masking control data stored in step 126, and thereafter added to the secondary pixel image in the main memory (step 132) at an address corresponding to (although not necessarily equivalent to) the currently stored X,Y address. The X,Y address updated in step 128 is mapped into a portion of main memory space reserved for the particular secondary pixel image being updated, the particular secondary pixel image being identified by an argument passed to the emulation routine when it was called. After any of steps 118, 120, 126, or 132, the routine returns to step 110 to begin reading and processing the next data appearing on the computer bus.

Thus, as may be seen from FIG. 6, each time the emulation routine is called, it continues to read and process data on the computer bus until invalid data is encountered. Each time valid data is read, bits included in the data or flags indicating what kind of information the data conveys are inspected in decision steps 112, 114, 116 and 122, and these steps direct the routine to appropriate action. Although the emulation routine shown in FIG. 6 is intended to emulate a preferred embodiment of the display controller 22 of FIG. 1, it should be understood that the nature of the emulation routine may be easily changed in order to accommodate other embodiments of the picture processor and display controller which may differ in the manner in which pixel and control data are encoded.

An improved graphics display system has been described that includes a picture processor for producing pixel and control data and for transmission to a display controller, the display controller storing the pixel data as a pixel image in a frame buffer memory and controlling a graphics display in accordance with the stored pixel image. A routing circuit inserted in the data path between the picture processor and the display controller selectively reroutes the data output of the picture processor to the control processor so that the control processor may create and maintain a secondary pixel image in the main memory.

While in the preferred embodiment of the invention, the control processor 14 updates secondary pixel images in response to the output of picture processor 20 via routing circuit 26, in alternative embodiments a dedicated instruction processor may be provided to perform that function, thereby freeing the control processor for carrying out other activities concurrently.

The additional processor may be connected to computer bus 18 in the same manner as control processor 14, or may be inserted in the data path between routing circuit 26 and bus 18 and provided with access to additional memory for storing secondary pixel images. In such embodiment, the additional processor can receive control and pixel data from the picture processor and update secondary pixel images without competing for use of computer bus 18.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A graphic display system for displaying portions of a graphic design defined by input instructions, the graphic design comprising displayed first portions and undisplayed second portions, the input instructions also indicating which portions of said graphic design are displayed first portions and which are undisplayed second portions, the graphics display system comprising:

a display controller for storing a primary pixel image comprising pixel data representing the first portions of the graphics design in accordance with first pixel data provided as input thereto and for generating a graphics display of the first portions in accordance with the primary pixel image;

a picture processor for producing first and second pixel data as output, the first pixel data representing the first portions of the design and the second pixel data representing the second portions of the design, said picture processor producing said first and second pixel data in response to input primary display lists comprising instructions to the picture processor for generating pixel data, said picture processor also producing the first pixel data in response to input secondary display lists directly including the first pixel data;

memory means for storing a secondary pixel image comprising second pixel data representing the second portions of the graphic design;

control processor means responsive to said input instructions for altering the secondary pixel image stored in the memory means in accordance with second pixel data output of the picture processor, for generating and transmitting a secondary display list to the picture processor when an input instruction indicates a previously undisplayed second portion of the graphic design is to become a displayed first portion, the secondary display list including pixel data of the secondary pixel image representing the previously undisplayed second portion of the graphic design; and means for conveying output first pixel data produced by the picture processor as input to the display controller for storage as the primary pixel image and for conveying output second pixel data produced by the picture processor as input to the control processor means for storage as the second pixel image.

2. The graphic display system in accordance with claim 1 wherein said memory means also stores a primary display list and wherein said control processor means includes means for altering the primary display list stored in the memory means in accordance with an input instruction indicating a change in the graphic design and for transmitting the altered primary display list to said picture processor.

3. A graphic display system for displaying portions of a graphic design defined by input instructions, the graphic design comprising displayed first portions and undisplayed second portions, the input instructions also indicating which portions of said graphic design are displayed first portions and which are undisplayed second portions, the graphics display system comprising:

a display controller for storing a primary pixel image comprising pixel data representing the first portions of the graphics design, for generating a graphics display of the first portions in accordance with the primary pixel image, and for altering the primary pixel image in accordance with first pixel data provided as input thereto;

a picture processor for producing first and second pixel data as output, the first pixel data representing the first portions of the design and the second pixel data representing the second portions of the design, said picture processor producing said first and second pixel data in response to input primary display lists comprising instructions to the picture processor for generating pixel data, said picture processor also producing the first pixel data in response to input secondary display lists directly including the first pixel data;

memory means for storing a primary display list and for storing a secondary pixel image comprising second pixel data representing the second portions of the graphic design;

control processor means for altering the primary display list stored in the memory means in accordance with an input instruction, for transmitting the altered primary display list to said picture processor, for altering the secondary pixel image stored in the memory means in accordance with second pixel data output of the picture processor, for generating and transmitting a secondary display list to the picture processor when an input instruction indicates a previously undisplayed second portion of the graphic design is to become a displayed first portion, the secondary display list conveying pixel data of the secondary pixel image representing the previously undisplayed second portion of the graphic design, and for producing a selection control signal indicating when said picture processor is producing said second pixel data; and means responsive to said control signal for conveying output first pixel data produced by the picture processor as input to the display controller for altering said primary pixel image and for conveying output second pixel data produced by the picture processor as input to the control processor means for altering said secondary pixel image.

4. A method of operation of a graphic display system displaying portions of a graphic design defined by input instructions, the graphic design comprising displayed first portions and undisplayed second portions, the input instructions also indicating which portions of said graphic design are displayed first portions and which are undisplayed second portions, the graphics display system comprising a display controller for storing a primary pixel image comprising pixel data representing the first portions of the graphics design in accordance with first pixel data provided as input thereto and for generating a graphics display of the first portions in accordance with the primary pixel image, a picture processor for producing first pixel data representing the first portions of the design and second pixel data representing the second portions of the design, said picture processor producing said first and second pixel data in response to input primary display lists comprising instructions to the picture processor for generating pixel data, and also producing first pixel data in response to input secondary display lists directly including the first pixel data, and memory means for storing a primary display list representing the graphic design and for storing a secondary pixel image representing the second portions of the graphic design, the method comprising the steps of:

storing the secondary pixel image in the memory means in accordance with second pixel data produced by the picture processor;

generating a secondary display list when an input instruction indicates a previously undisplayed portion of the graphic design is to be displayed, the secondary display list including second pixel data of the secondary pixel image representing the previously undisplayed portion of the graphic design;

transmitting said secondary display list to said picture processor such that said picture processor produces first pixel data representing said previously undisplayed portion of the graphic design; and transmitting said first pixel data representing said previously undisplayed portion of the graphic design from said picture processor to said display controller such that said display controller alters said primary pixel image in accordance therewith.

5. A method of operation of a graphic display system displaying portions of a graphic design defined by input instructions, the graphic design comprising displayed first portions and undisplayed second portions, the input instructions also indicating which portions of said graphic design are displayed first portions and which are undisplayed second portions, the graphics display system comprising a display controller for storing a primary pixel image comprising pixel data representing the first portions of the graphics design in accordance with first pixel data provided as input thereto and for generating a graphics display of the first portions in accordance with the primary pixel image, a picture processor for producing first pixel data representing displayed first portions of the design and second pixel data representing undisplayed second portions of the design, said picture processor producing said first and second pixel data in response to input primary display lists comprising instructions to the picture processor for generating pixel data, said picture processor also producing first pixel data representing displayed first portions of the design in response to input secondary display lists directly including the first pixel data, and memory means for storing a primary display list representing the graphic design and for storing a secondary pixel image comprising second pixel data representing undisplayed second portions of the graphic design, the method comprising the steps of:

altering the primary display list stored in the memory means in accordance with an input instruction when said input instruction indicates any portion of the graphic design is to be altered;

transmitting the altered primary display list to said picture processor such that said picture processor produces pixel data in response to said primary display list;

transmitting first pixel data produced by the picture processor in response to the altered display list to said display controller such that said display controller alters said primary pixel image in accordance therewith;

storing the secondary pixel image in the memory means in accordance with the second pixel data produced by the picture processor in response to the altered display list;

generating a secondary display list when an input instruction indicates a previously undisplayed portion of the graphic design is to be displayed, the secondary display list including pixel data of the secondary pixel image representing the previously undisplayed portion of the graphic design;

transmitting said secondary display list to said picture processor such that said picture processor produces first pixel data representing said previously undisplayed portion of the graphic design; and transmitting said first pixel data representing said previously undisplayed portion of the graphic design from said picture processor to said display controller such that said display controller alters said primary pixel image in accordance therewith.

* * * * *